United States Patent [19]

Swartz

[11] Patent Number: 5,041,312

[45] Date of Patent: Aug. 20, 1991

[54] APPARATUS AND METHOD FOR COATING A METAL STRIP

[76] Inventor: LeRoy Swartz, 4541 Garland Rd., Bensalem, Pa. 19020

[21] Appl. No.: 479,380

[22] Filed: Feb. 13, 1990

[51] Int. Cl.[5] ..... B05C 15/00; B05D 3/00

[52] U.S. Cl. ..... 427/378; 118/326; 118/DIG. 7; 118/61; 34/79; 34/223

[58] Field of Search ..... 118/61, 326, DIG. 7; 427/378; 239/125; 34/219, 223, 224, 23, 79

[56] References Cited

U.S. PATENT DOCUMENTS

| | | | |
|---|---|---|---|
| 2,833,672 | 5/1958 | Laubscher et al. | 427/46 |
| 3,008,119 | 12/1962 | Gotsch | 439/880 |
| 3,561,131 | 2/1971 | Swartz | 34/73 |
| 3,576,664 | 4/1971 | Swartz | 437/46 |
| 4,206,553 | 6/1980 | Ellison et al. | 34/79 |
| 4,266,504 | 5/1981 | Roesner | 118/DIG. 7 |
| 4,370,357 | 1/1983 | Swartz | 427/46 |

FOREIGN PATENT DOCUMENTS

| | | |
|---|---|---|
| 1304899 | 1/1963 | France . |
| 1604272 | 11/1971 | France . |

*Primary Examiner*—Richard V. Fisher
*Assistant Examiner*—Charles Friedman
*Attorney, Agent, or Firm*—Austin R. Miller

[57] ABSTRACT

Metal strip is coated with a coating material containing a volatilizable solvent and is heated in an enclosure for vaporizing the solvent. Condensation of vapors on the metal strip within the enclosure is avoided by providing an exhaust of sufficient capacity to withdraw all of the heated and vaporized solvent, after which it is burned, mixed with a gas having a temperature lower than its temperature, and returned into the enclosure and applied against the surface of the metal strip.

16 Claims, 3 Drawing Sheets

APPARATUS AND METHOD FOR COATING A METAL STRIP

This invention relates to an apparatus and method for coating a metal strip, and particularly relates to the treatment of a metal strip coated with a coating material such as paint or the like which contains a volatilizable solvent. The coated strip is passed through a heating zone for vaporizing the solvent, and for ecological and other reasons the apparatus is provided with an enclosure to confine the vaporized solvent.

Prior Art

In my U.S. Pat. No. 3,561,131 granted Feb. 9, 1971 I disclose an apparatus for continuously uncoiling a strip, coating it with a coating such as paint, heating the strip to drive off solvent from the coating, and then conducting the resulting coated strip over one or more cooling devices, followed by recoiling the strip. In that patent and in its division U.S. Pat. No. 3,576,664, granted Apr. 27, 1971, the uncoiled strip was shown as being subjected to scrubbing, rinsing, chemical coating, rinsing, drying and then to painting on one face or both faces of the strip. After painting the strip was moved in an upward direction past an induction coil which heated the strip, thereby driving off solvent from the coating. The vaporized solvent was condensed in an enclosure and conducted to a solvent recovery tank, while any excess vapors were conducted through an afterburner and to the atmosphere. The heated strip was conducted over a series of cooling rollers and returned to a recoiler.

Condensation of vaporized solvent in the same enclosure that contains the strip itself has now been found to result in deposition of solvent upon the surface of the strip. This is highly undesirable since it causes discoloration and unevenness of the coated surface, and otherwise downgrades the visual appearance of the strip and the uniformity of corrosion resistance and other quality requirements of the strip.

Objects of the Invention

It is accordingly an object of this invention to provide a method and apparatus for drying a coated metal strip while maintaining vaporized solvent in the same enclosure with the strip, while preventing condensation or deposition of the vaporized solvent upon the strip. Still another object of the invention is to provide a coated metal strip having remarkably uniform thickness of surface coating and remarkable uniformity o coating throughout the surface. Still another object of this invention is to provide a method and apparatus for making such a strip, wherein the strip is uniformly coated on both strip surfaces. Other objects and advantages of this invention, including the ecological advantages of solvent containment and treatment and the ease with which it may be adapted to coatings of a wide variety of different types, will become apparent hereinafter and in the drawings, of which:

Figure 1:
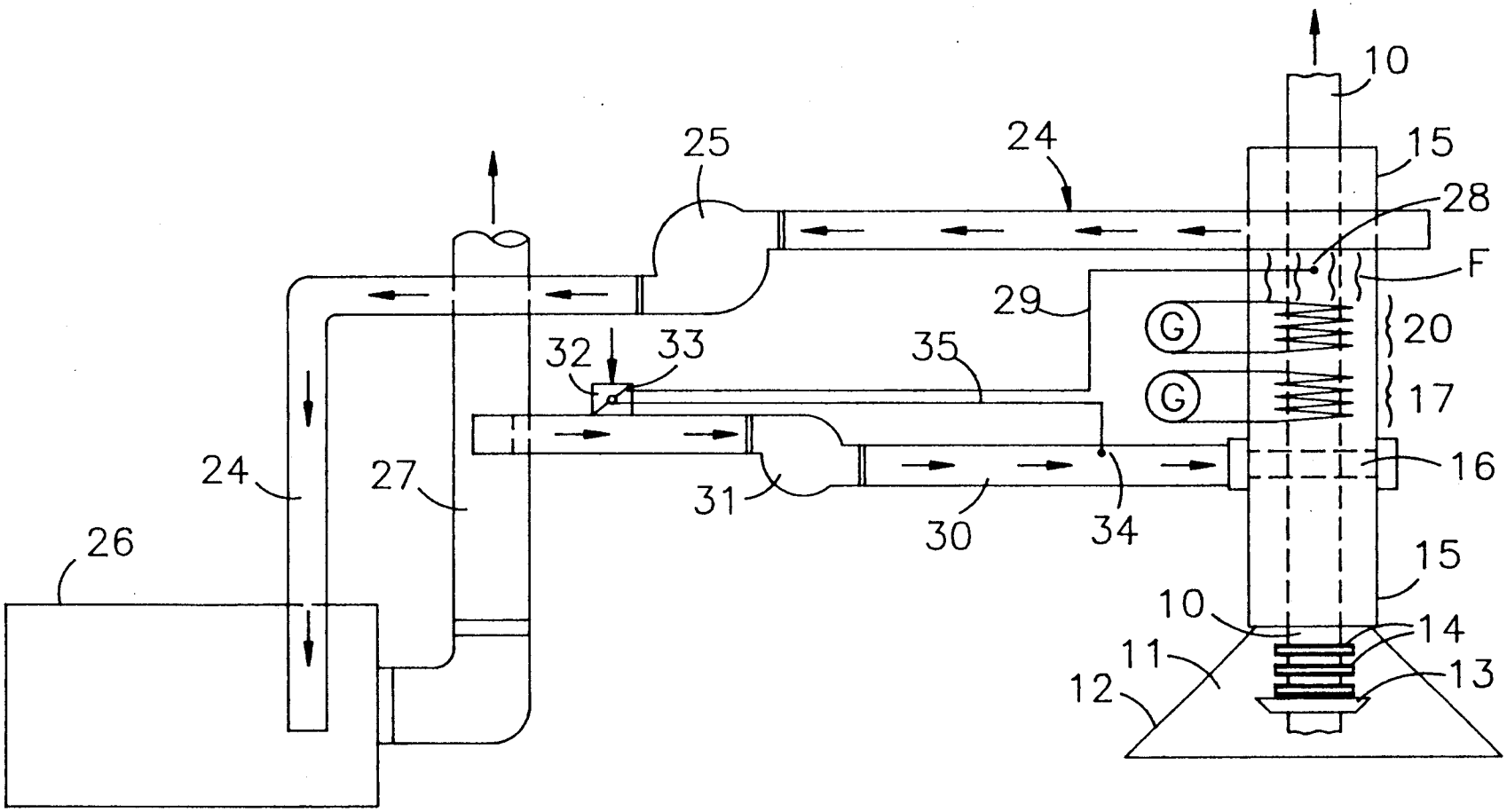
FIG. 1 is a diagrammatic view in side elevation showing a plant layout illustrating a typical apparatus and method in accordance with this invention.

Although the description which follows will utilize specific terms for the sake of convenience, and will refer to the particular forms of the invention selected for illustration in the drawings, these drawings and the related description are not intended to define or to limit the scope of the invention, which is defined in the appended claims.

DETAILED DESCRIPTION OF THE INVENTION

Referring to the drawings, the number 10 designates the strip which, as shown in FIG. 1, is moving in an upward direction (downstream) having already been subjected to one o more preliminary steps (not shown) such as uncoiling, scrubbing, rinsing, chemical coating, further rinsing, drying and the like, all of which steps are well known in the art and were discussed in some detail in my earlier U.S. Pat. Nos. 3,561,131 and 3,576,664, for example. The number 12 designates the hood of a paint coater room 11, and the number 13 is intended to indicate containers for paint or other coating liquid, applied by one or more conventional coating applicator rolls 14. The strip 10, having thus been coated or painted, enters the curing chamber 15, comprising an enclosure provided to form a substantially enclosed space substantially surrounding an upstream induction heater 17 and a downstream induction heater 20, which are operated by generators 21 and 22 for providing induction heat to the metal strip 10. The heat applied by the heaters 17, 20 vaporizes solvent contained in the liquid coating, forming fumes F at an upper portion of the curing chamber 15.

As the strip 10 passes in a downstream direction toward the upstream induction heater 17 it passes between a pair of adjustable louvers 16, which are an important feature of this invention and will be described in further detail hereinafter.

In its further downstream movement, after having passed the heaters 17, 20, the strip 10 passes an exhaust line 24 and then passe out through a solvent-confining strip slot 23 (FIG. 2) as it exits the curing chamber 15.

The exhaust line 24 includes an exhaust blower 25 and removes essentially all of the solvent carried off from the strip. The line 24 conducts the solvent to an afterburner or incinerator 26 which is provided with a stack 27 for releasing thoroughly incinerated and ecologically acceptable combustion product to the atmosphere. However, not all of the incinerated solvent is permitted to be released to the atmosphere, since a mixed gas injection line 30 is provided, downstream of the afterburner 26, and provided with a hot mixed gas accumulator blower 31 for blowing some of the incinerated solvent back through the mixed gas injection line 30 into an upstream portion of the curing chamber 15. The mixed gas injection line 30 is provided with an air inlet 32 controlled by a butterfly control valve 33, which meters a certain percentage of cooling gas, such as fresh air, into the recycled incinerated solvent gas to form a controlled mixture which is blown by the blower 31 into the curing chamber 15 through the pair of louvers 16.

The number 34 designates a thermostat, connected by means of a control line 35 to the butterfly control valve 33, thereby controlling the proportion of fresh air introduced through the air inlet 32 in response to the variations of temperature as measured by the thermostat 34 in the mixed gas injection line adjacent to the curing chamber 15.

Figure 2:
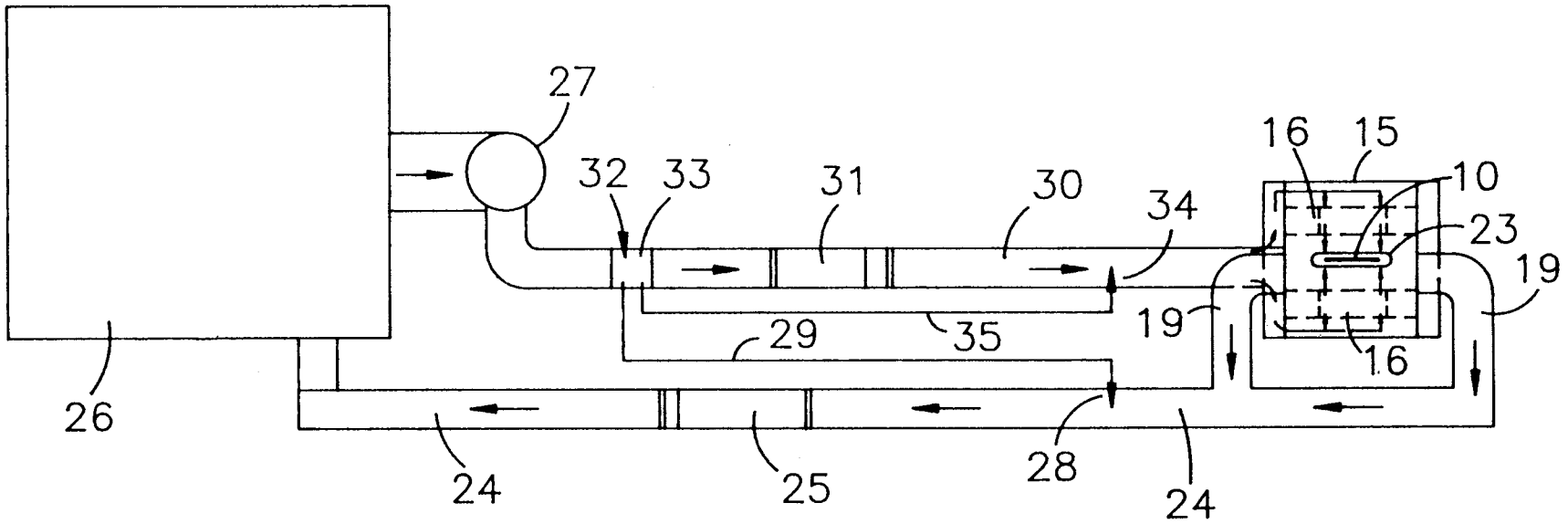
FIG. 2 is a plan view of the apparatus shown in FIG. 1.

It will be appreciated from a study of FIGS. 1 and 2 that there are provided at least two of the adjustable louvers 16 and that they are spaced apart from each other facing toward opposite faces of the strip 10. As is shown particularly clearly in FIG. 2, the mixed gases blown through the mixed gas injection line 30 are caused to divide, with a portion flowing through one adjustable louver 16 and the other portion flowing through the other adjustable louver 16. In this manner the mixed gases are formed into opposed curtains which ar directed onto opposed surfaces of the strip 10 prior to the time the strip 10 reaches the upstream induction heater 17 or the downstream induction heater 20. This is an important and advantageous feature of the invention.

Figure 3:
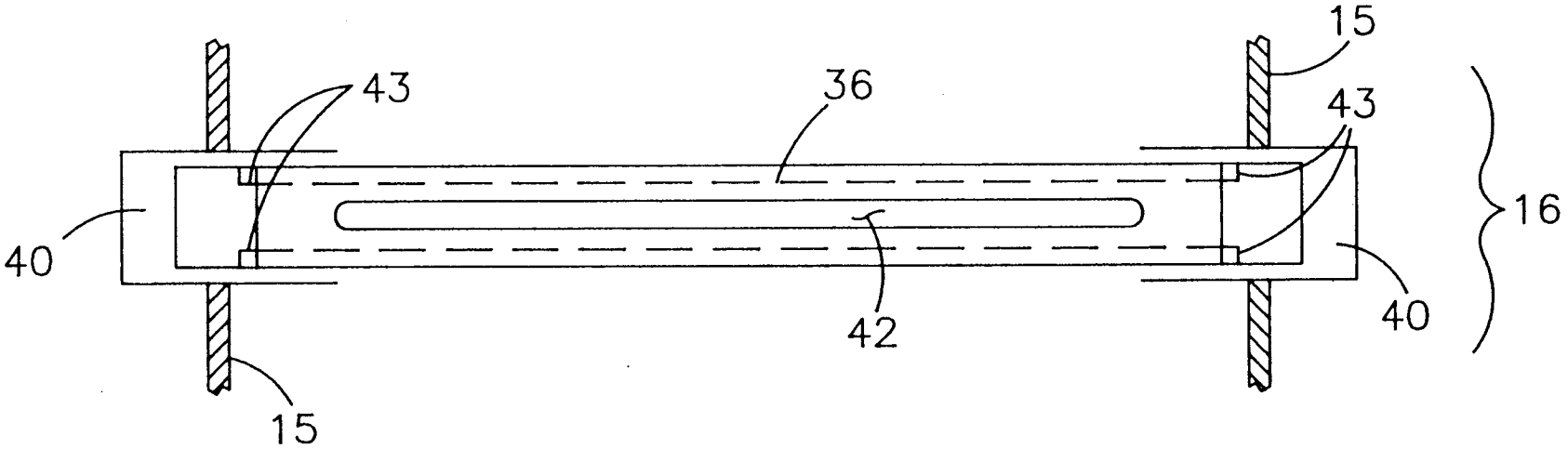
FIG. 3 is an enlarged view, partially in section, showing a strip louver comprising one component appearing in the apparatus of FIGS. 1 and 2.

Turning now to FIG. 3, each adjustable louver 16 includes a slot 42 through which the mixed gas from the injection line 30 is blown. This forms the gas flow through each slot 42 into a curtain which is applied to on surface or the other of the strip 10 with the result that at least two curtains of heated mixed gas are applied to opposite surfaces of the strip 10. Each adjustable slot 42 is formed in an adjustable cylinder 36, maintained in brackets 40 secured to the wall 15 of the curing chamber. The number 43 designates a plurality of set screws which can be used to set the cylinder 36 at any angle of rotation, in order to adjust the applicable angle of the curtain of heated gases passing through the slot 42. Accordingly the two louvers 16 control the direction and flow of the heated mixture of incinerated solvent and fresh air, and the two louvers 16,16 working together apply opposed curtains of hot ga on both faces of the strip 10. They may be spaced at any desired distance from the strip 10 and angled at any desired angle and when properly placed and directed they are important in avoiding the condensation of vapors upon the strip at any location within the enclosure 15.

Although reference has been made to a control thermostat 34 which is operative and effective through a control line 35, it is also possible to provide another thermostat 28 within the chamber 15, downstream of the downstream induction heater 20, and to provide a control line 29 linking this thermostat also to the butterfly control valve 33, in order to control the operation of the butterfly control valve 33 in the event that insufficient control is obtained from the operation of the thermostat 34 working alone.

It is also important to observe, in FIG. 2, that branch lines 19, 19 are provided for pulling gases from both sides of the strip as the gases are conducted to and through the exhaust line 24 This is instrumental in preventing fume build up adjacent the strip 10 and assists in protecting the surfaces of the strip 10.

Operation

The operation of the apparatus and method will now become apparent. The incoming pre-treated strip 10, as it passes into the curing chamber 15, is met on both strip faces by curtains of heated gas, preferably maintained at 700°-900° F. and comprising a mixture of incinerated solvent from the afterburner 26 and a cooling gas having a lower temperature, such as ambient air brought in through the air inlet 32. Upstream heating occurs at the induction heater 17 while in the presence of the curtain of this protective gas, and further heating takes place at the downstream induction heater 20, within the same enclosure. The provision of curtains of heated gas is significant in avoiding the condensation of vapors on the surfaces of the strip 10, even though the fumes F tend to form, as indicated in FIG. 1, in the area downstream of the downstream heater 20. The exhaust line 24 is positioned to remove the solvent liberated by the heating operations, and leaves the coil strip 10 free to exit the curing chamber for further operations such as cooling, recoiling and the like.

It is highly preferred to control the gas temperature in the area of the exhaust line 24, within the curing chamber 15, at about 250°-300° F. and the thermostat 28 may be set for that purpose. It is also highly desirable to control the gas temperature of the mixed gas injection line 30, as it enters the adjustable louvers 16, to a temperature of about 700°-900° F. It has been found that with these control parameters particularly excellent results are achieved without permitting any condensation of vapors in the induction curing enclosure 15 or upon the surface of the coil strip 10 as it passes through.

It will accordingly be appreciated that this invention provides, in an apparatus for coating a metal strip, technology providing for the coating of the metal strip with a coating material containing a volatilizable solvent, and providing for vaporizing the solvent in a substantially enclosed space with significant environmental advantage, and yet for treating the vaporized solvent and preventing it from condensing on the metal strip as it passes through the substantially enclosed space. The apparatus in accordance with this invention provides an exhaust means which is connected to the enclosure downstream of the heating means to withdraw the heated and vaporized solvent, coupled with a burner or an incinerator connected to receive the solvent from the exhaust means for decomposing the withdrawn solvent and producing combustion gas from the burned solvent, together with a return means connected to the enclosure upstream of the induction heating means for returning at least a portion of the combustion gas to the enclosure, and means for mixing the returned combustion gas with another gas such as ambient air, having a temperature lower than the temperature of the combustion gas. It is highly preferable that the returned combustion gas mixture be applied upon the faces of the strip in the form of a curtain of heated gas, travelling along with the strip surfaces as they move through the enclosure.

Although this invention has been described with reference to specific forms thereof, and to the use of particular heating means such as induction heating means, it will be appreciated that man variations may be made without departing from the spirit and scope of the invention. All such variations, including reversals of parts or reversals of sequence of method steps, or the use of equivalent elements in place of those particularly shown and described herein, are intended to be within the scope of the invention, as defined in the appended claims.

I claim:

1. In an apparatus for coating a metal strip, wherein the metal strip is coated with .a coating material containing a volatilizable solvent and passed in a downstream direction through a heating station having a heating means for vaporizing the solvent, and wherein an enclosure is provided to form a substantially enclosed space substantially surrounding said heating means, apparatus for treating the vaporized solvent and preventing it from condensing on the metal strip as it passes through said substantially enclosed space, which apparatus comprises:

(a) exhaust means comprising at least two conduits connected to said enclosure downstream of said heating means adjacent opposite strip edges to withdraw the heated and vaporized solvent therefrom, (b) burner means connected to receive said solvent from said exhaust means for decomposing said withdrawn solvent and producing combustion gas from said decomposed solvent, (c) return means connected to said enclosure upstream of said heating means for returning at least a portion of said combustion gas to said enclosure, and (d) means for mixing with said returned combustion gas another gas having a temperature lower than that of said combustion gas, and for directing the resulting gaseous mixture at a surface of the metal strip within said enclosure.

2. The apparatus defined in claim 1, wherein said other gas is air.

3. The apparatus defined in claim 2, wherein said air is at ambient temperature.

4. The apparatus defined in claim 1, temperature sensing means are provided in said return means, and wherein control means are provided, operative in response to said temperature sensing means, for controlling the mix of said combustion gas and said other gas.

5. The apparatus defined in claim 1, wherein control means are provided for controlling the temperature of the gas flowing from said return means to said enclosure.

6. The apparatus defined in claim 1, wherein means are provided for exhausting a portion of said combustion gas to atmosphere.

7. The apparatus defined in claim 1, wherein temperature measuring means are provided in said enclosure, and wherein control means are provided, responsive to said temperature measuring means, for controlling the mix of the gas returned to said enclosure, to maintain the temperature of said enclosure within predetermined limits.

8. In an apparatus for coating a metal strip, wherein the metal strip is coated with a coating material containing a volatilizable solvent and passed in a downstream direction through a heating station having a heating means for vaporizing the solvent, and wherein an enclosure is provided to form a substantially enclosed space substantially surrounding said heating means, apparatus for treating the vaporized solvent and preventing it from condensing on the metal strip as it passes through said substantially enclosed space, which apparatus comprises:

(a) exhaust means connected to said enclosure downstream of said heating means to withdraw the heated and vaporized solvent therefrom, (b) burner means connected to receive said solvent from said exhaust means for decomposing said withdrawn solvent and producing combustion gas from said decomposed solvent, (c) return means connected to said enclosure upstream of said heating means for returning at least a portion of said combustion gas to said enclosure, said return means including louvers arranged to direct curtains of returned gas upon the faces of said strip in said enclosure, and (d) means for mixing with said returned combustion gas another gas having a temperature lower than that of said combustion gas, and for directing the resulting gaseous mixture at said faces of the metal strip within said enclosure.

9. In a method for coating a metal strip, wherein the metal strip is coated with a coating material containing a volatilizable solvent and passed in a downstream direction through a heating station having a heating means for vaporizing the solvent, and wherein an enclosure is provided to substantially contain the solvent vaporized by said heating means, a method for preventing the vaporized solvent from condensing on the metal strip, which method comprises:

(a) withdrawing the heated and vaporized solvent from said enclosure at at least two positions located adjacent opposite edges of the strip downstream of said heating means, (b) burning said withdrawn solvent and producing combustion gas from said burned solvent, (c) returning at least a portion of said combustion gas to said enclosure, (d) mixing with said returned combustion gas another gas having a temperature lower than that of said combustion gas, and (e) directing the resulting gaseous mixture against a surface of said strip in said enclosure.

10. The method defined in claim 9, wherein said other gas is air.

11. The method defined in claim 10, wherein said air is at ambient temperature.

12. The method defined in claim 9, comprising the further steps of measuring the temperature of the mixed gas and controlling the mix of said combustion gas and said other gas in response to such measurement.

13. The method defined in claim 9, including the further step of controlling the flow rate of said other gas.

14. The method defined in claim 9, including the further step of exhausting a portion of said combustion gas to atmosphere.

15. The method defined in claim 9, including the further steps of measuring the temperature of the gas in the enclosure and controlling the flow of said other gas returned to said enclosure, to maintain the temperature of the mixed gas within predetermined limits.

16. The method defined in claim 9, including the step of directing curtains of said returned gas against opposite surfaces of said strip as it moves in said enclosure.

* * * * *